US011619022B2

(12) United States Patent
Jablonka

(10) Patent No.: US 11,619,022 B2
(45) Date of Patent: Apr. 4, 2023

(54) COMPOSITE DRAINBOARD FOR BLINDSIDE APPLICATION, AND FOUNDATION ASSEMBLY

(71) Applicant: EWALD DÖRKEN AG, Herdecke (DE)

(72) Inventor: Marcus Jablonka, Vineland (CA)

(73) Assignee: EWALD DÖRKEN AG, Herdecke (DE)

( * ) Notice: Subject to any disclaimer, the term of this patent is extended or adjusted under 35 U.S.C. 154(b) by 0 days.

(21) Appl. No.: 17/361,459

(22) Filed: Jun. 29, 2021

(65) Prior Publication Data

US 2021/0404138 A1 Dec. 30, 2021

Related U.S. Application Data

(60) Provisional application No. 63/045,785, filed on Jun. 29, 2020.

(51) Int. Cl.
*E02D 31/02* (2006.01)
*E02D 31/00* (2006.01)

(52) U.S. Cl.
CPC ..... *E02D 31/004* (2013.01); *E02D 31/025* (2013.01); *E02D 2300/0089* (2013.01)

(58) Field of Classification Search
CPC ..... E02D 31/02; E02D 31/025
USPC ..... 405/43, 45, 50; 52/169.5, 169.14
See application file for complete search history.

(56) References Cited

U.S. PATENT DOCUMENTS 3,754,362 A * 8/1973 Daimler ..... E04B 1/7023 405/36
4,574,541 A * 3/1986 Raidt ..... E02D 31/02 52/796.1
4,733,989 A * 3/1988 Harriett ..... C09J 123/02 405/50
4,840,515 A * 6/1989 Freese ..... E02D 31/02 405/36
4,943,185 A * 7/1990 McGuckin ..... E02B 11/00 405/38
4,956,951 A * 9/1990 Kannankeril ..... E02D 31/02 405/36
5,044,821 A * 9/1991 Johnsen ..... E02D 31/02 52/169.5

(Continued)

OTHER PUBLICATIONS

"PMI PM Geo-Tec dimpled membrane with fleece and sliding foil 15 m×2.00 m", https://web.archive.org/web/20171224201122/https://www.bausep.de/pmi-pm-geo-tec-noppenbahn-mit-vlies-und-gleitfolie-15-m-x-2-00-m.html, Sep. 27, 2022, 21 pages.

(Continued)

*Primary Examiner* — Frederick L Lagman
(74) *Attorney, Agent, or Firm* — Dinsmore & Shohl LLP

(57) ABSTRACT

A composite drainboard includes a patterned substrate core having an inward surface, and opposed outward facing surface. The substrate core comprises a plurality of projections, forming concavities on the inward surface. A first geotextile membrane is attached to the substrate core and covers the outward facing surface. A second membrane is attached to the substrate core to cover the inward facing surface and the concavities to provide a substantially smooth coating to the inward surface. The second membrane at least partially absorbs a liquid applied waterproofing.

23 Claims, 6 Drawing Sheets

(56) References Cited

U.S. PATENT DOCUMENTS 5,263,792 A * 11/1993 Davis ..... E02B 11/00 428/137
5,383,314 A * 1/1995 Rothberg ..... E02D 31/02 428/128
5,489,462 A * 2/1996 Sieber ..... E02D 31/02 52/302.1
5,688,073 A * 11/1997 Brodeur ..... E02D 31/02 405/36
5,860,259 A * 1/1999 Laska ..... E04B 1/7612 52/404.1
6,241,421 B1 * 6/2001 Harvie ..... E02D 31/02 405/36
6,691,472 B2 * 2/2004 Hubert ..... E02D 31/02 52/408
7,698,858 B2 * 4/2010 Schroer ..... E04H 9/145 405/36
8,609,213 B2 * 12/2013 Wiercinski ..... C09J 7/20 428/354
9,771,703 B1 * 9/2017 Golding, Jr. ..... B32B 5/022
2015/0259900 A1 * 9/2015 Humphreys ..... E04D 13/1675 428/40.3
2018/0010329 A1 * 1/2018 Golding, Jr. ..... B32B 5/26
2019/0271157 A1 * 9/2019 Baggs ..... B32B 7/06
2020/0240101 A1 * 7/2020 Rudyan ..... E02D 31/025
2020/0370268 A1 * 11/2020 Rudyan ..... B01D 71/06

OTHER PUBLICATIONS

"PMI PM Geo-Tec Noppenbahn mit Vlies und Gleitfolie 15 m×2,00 m", https://web.archive.org/web/20171224201122/https://www.bausep.de/pmi-pm-geo-tec-noppenbahn-mit-vlies-und-gleitfolie-15-m-x-2-00-m.html, Sep. 27, 2022, 21 pages.

"Basement protection—Drainage sheets in three layers", https://web.archive.org/web/20201001114527/https://www.pmi-plast.com/en/drainage-sheets-in-three-layers.html, Nov. 11, 2021, 2 pages.

* cited by examiner

COMPOSITE DRAINBOARD FOR BLINDSIDE APPLICATION, AND FOUNDATION ASSEMBLY

CROSS-REFERENCE TO RELATED APPLICATIONS

This application claims priority from U.S. provisional application No. 63/045,785, filed Jun. 29, 2020, the contents of which are hereby incorporated herein by reference.

FIELD

This relates to building foundations, and more particularly to foundation drainage and waterproofing.

BACKGROUND

In large cities/metropolitan areas, little space is often available around a building jobsite, providing limited access to foundation walls near adjacent properties. At the same time, property is valuable, and construction strives to utilize all (or almost all) available land.

Foundations are thus installed as close to property lines as possible. To that end, often a soil retention system is first installed—soldier piles are driven into the ground first and wood lagging is inserted. Thereafter, the building/foundation hole is dug, often several stories deep into the ground. This is typical for foundations of large apartment/office buildings, underground parking garages, etc. in large cities.

To provide for below-ground water drainage, a water drainage layer may be installed directly against the wood lagging wall. The drainage layer may take the form of drainboard. Often, an additional waterproofing layer is applied inboard of the drainboard.

A concrete foundation wall is poured against the water drainage or waterproofing layer. Ideally, the waterproofing layer will bond to the freshly poured concrete, so that no surface/rain water can find its way between the waterproofing layer and the concrete wall.

At this juncture there is limited access to the waterproofing layer—it is said to be installed blindsided.

The drainage layer outside the waterproofing will intercept ground water and allow it to drain downwards towards a footer drain or other water drainage or collection facility from where it is collected and pumped above ground.

A number of different waterproofing types have typically been used in these applications: bentonite (expansive clay mats; the clay expands when it gets wet and thus creates a seal); torched on asphalt-based membranes; peel&stick asphalt-based membranes; and liquid-applied waterproofing (could be spray-applied, roller-applied, brush-applied).

Accordingly there is a need for a new foundation assembly, and drainboard for blind-sided application.

SUMMARY

According to an aspect, there is provided a composite drainboard that includes a patterned substrate core having an inward surface, and opposed outward facing surface. The substrate core comprises a plurality of projections, forming concavities on the inward surface. A first geotextile membrane is attached to the substrate core and covers the outward facing surface. A second membrane is attached to the substrate core to cover the inward facing surface and the concavities to provide a substantially smooth coating to the inward surface. The second membrane at least partially absorbs a liquid applied waterproofing.

According to another aspect, there is provided a foundation assembly, comprising a lagging layer adjacent to soil; a blindside drainage layer comprising: a drainboard with a patterned substrate core having an inward surface, and opposed outward facing surface, the outward facing surface connected to the lagging layer. The substrate core comprising a plurality of projections, forming concavities on the inward surface. A geotextile membrane is attached to the substrate core and covers the outward facing surface. A fiber membrane is attached to the substrate core and covering the inward surface to provide a substantially smooth coating to the inward surface, wherein the fiber membrane absorbs a liquid waterproofing. A liquid-applied waterproofing layer is applied to the fiber membrane, and at least partially absorbed by the fiber membrane. A poured concrete wall having an outer face is in contact with the liquid-applied waterproofing layer.

A method of forming a foundation, comprises forming a lagging layer adjacent to soil; installing a plurality of composite drainboards on the lagging layer, each of the plurality of composite drainboards comprising a patterned substrate core having an inward surface, and opposed outward facing surface, the substrate core comprising a plurality projections, forming concavities on the inward surfaces; a first geotextile membrane attached to the substrate core and covering the outward facing surface; a second membrane attached to the substrate core and covering the inward facing surface and the concavities to provide a substantially smooth coating to the inward surface. The method further comprises applying liquid waterproofing to the second membrane to form a waterproofing layer; and pouring a concrete layer after applying the liquid waterproofing in contact with the waterproofing layer to form a concrete wall.

Other features will become apparent from the drawings in conjunction with the following description.

BRIEF DESCRIPTION OF THE DRAWINGS

In the figures which illustrate example embodiments.

DETAILED DESCRIPTION

Figure 1:
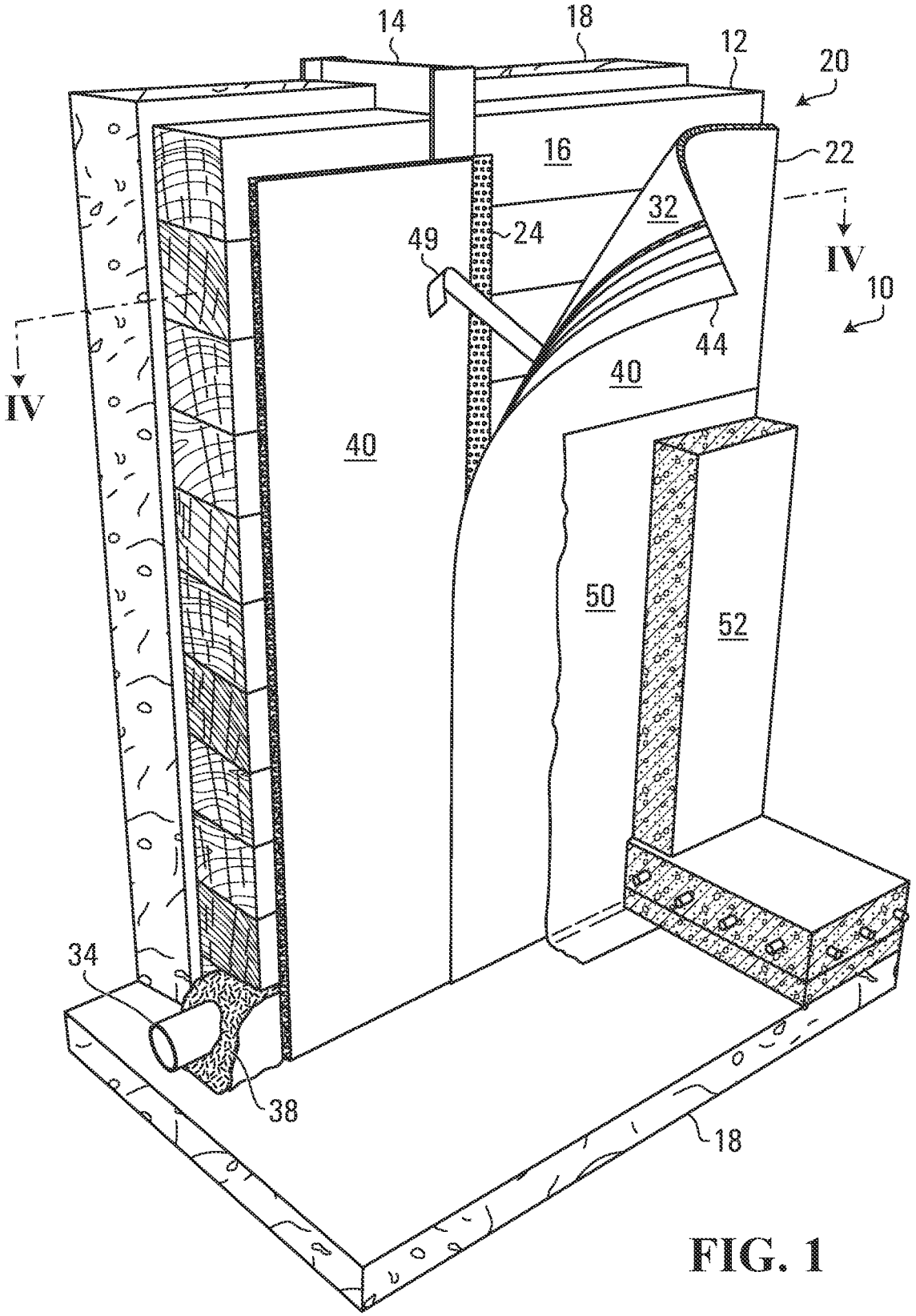
FIG. 1 is a fragmentary view of an exemplary foundation assembly.
Figure 2:
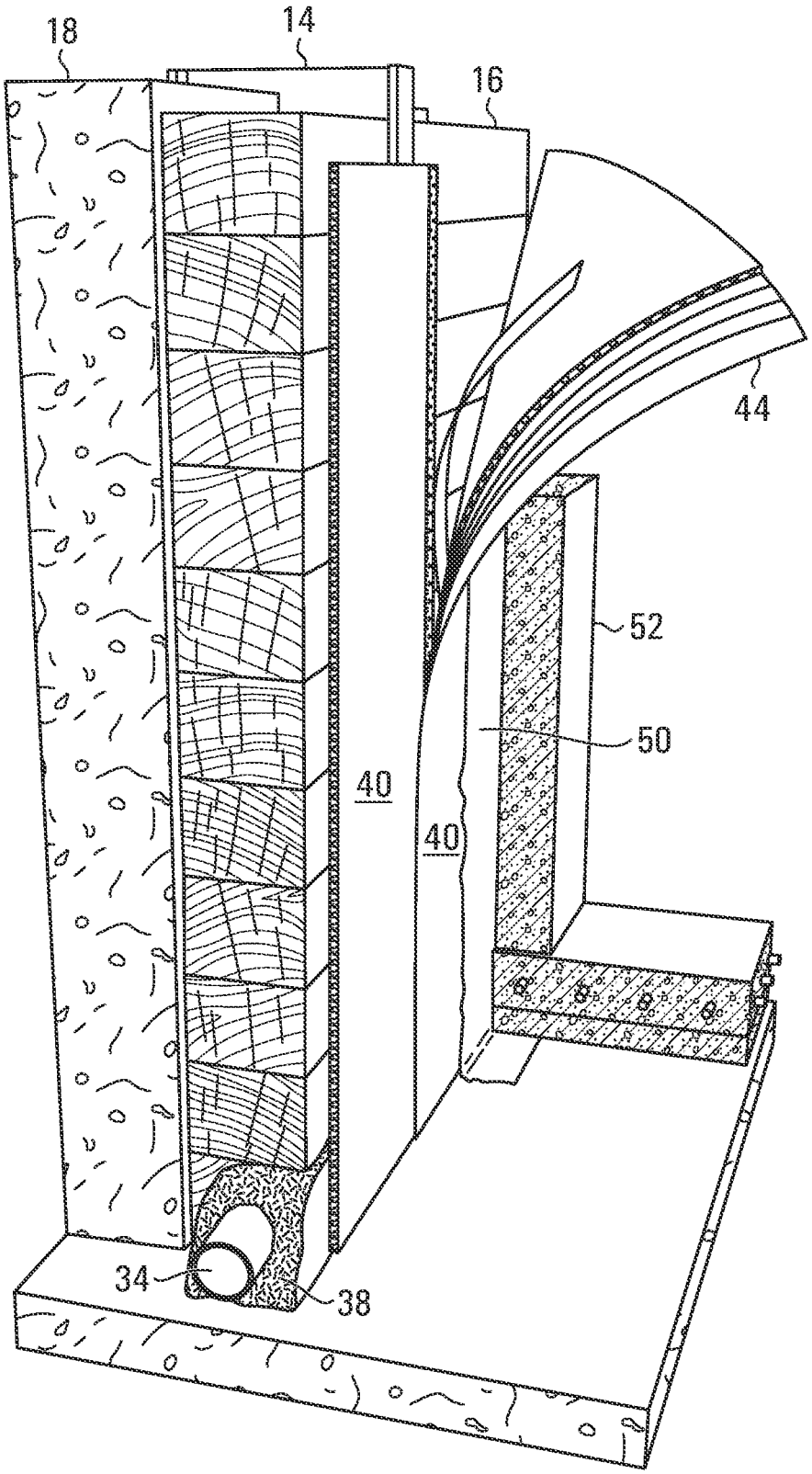
FIG. 2 is a fragmentary end view of an exemplary foundation assembly.

FIGS. 1 and 2 illustrate a foundation assembly 10, exemplary of an embodiment. Foundation assembly 10 is formed "blind sided", with access to only an interior side of foundation assembly 10 during assembly. Foundation assembly 10, for example, may be formed against existing property boundaries that do not allow access beyond boundaries.

Foundation assembly 10 includes a lagging layer 12, formed in soil 18, typically near the property boundary on which foundation assembly 10 is formed. In the depicted embodiment, lagging layer 12 may be formed using steel posts 14 that support horizontally extending wood boards 16. Posts 14 may be pile driven into the ground, and boards 16 may be retained in posts 14—for example in a groove or otherwise. Posts 14 may be steel I-beams, or other suitable posts. Boards 16 may be conventional lumber or composite boards, and may for example be formed of cut lumber or plywood. Posts 14 and boards 16 are adjacent to soil 18, and may retain soil 18, exterior to foundation assembly 10. Alternate lagging layers may be formed using concrete boards, A drainage pipe 34 embedded in gravel 38 may be placed at the base of lagging layer 12, and at the base of foundation assembly 10.

Figure 4:
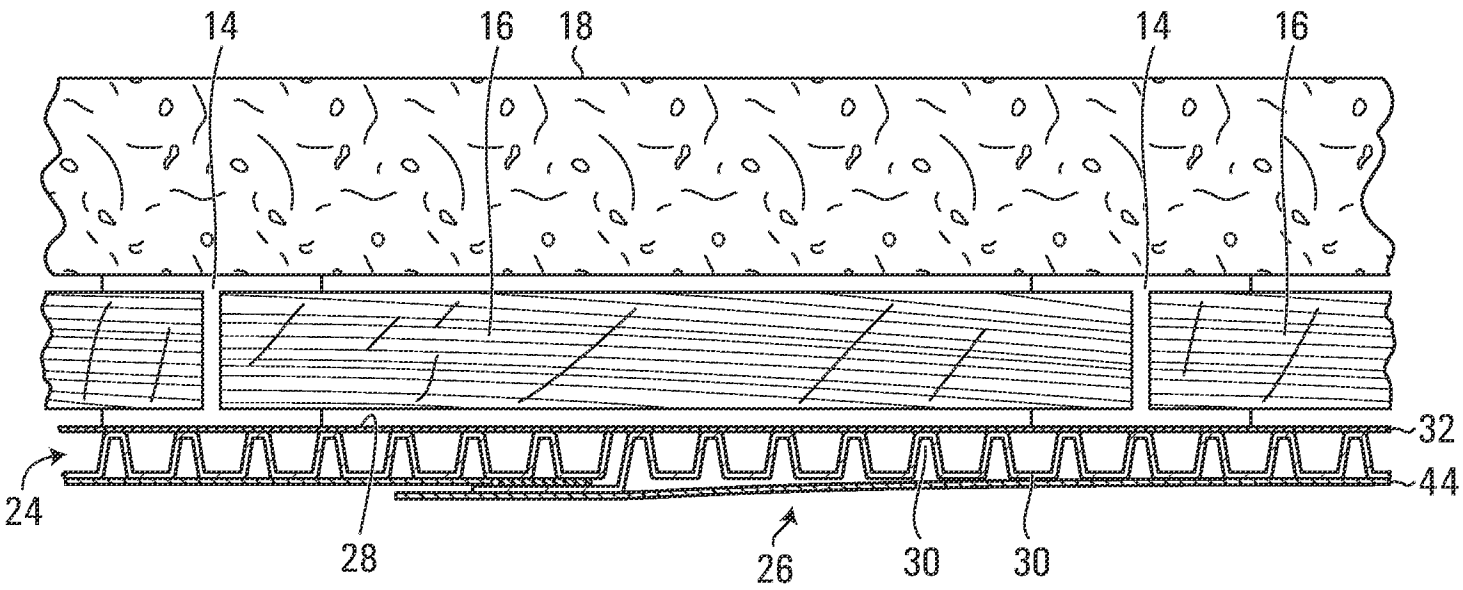
FIG. 4 is a schematic top cross-sectional view a portion of the foundation assembly of FIG. 1 along lines IV-IV.
Figure 5:
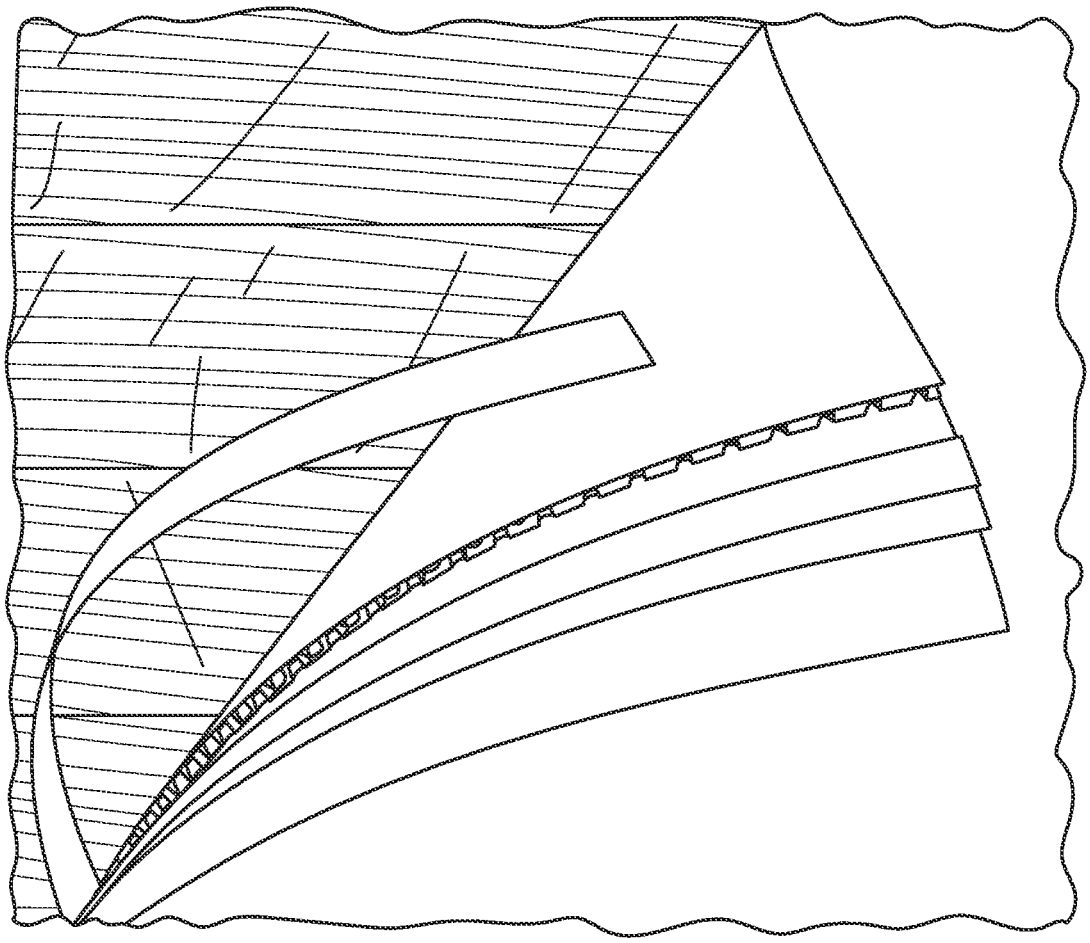
FIG. 5 is an enlarged fragmentary view of a portion of FIG. 1.

An exemplary blindside drainage layer 20 may be attached to lagging layer 12. Drainage layer 20 includes composite drainboard 22. Drainboard 22 may be applied in cut sheets 40, placed adjacent each other. Sheets 40 are typically oriented vertically, horizontal edges placed in overlapping relationship, as described below, and as depicted in FIGS. 1, 2 and 4. Sheets 40 could alternatively be installed with overlapping edges oriented horizontally. Sheets 40 may be installed by nailing, screwing, gluing or otherwise attaching or placing sheets 40 to lagging layer 12.

As will become apparent, composite drainboard 22 includes a substrate core 24, covered by a first membrane 32 and a second membrane 44, also as described below. A waterproofing layer 50 is further applied as a liquid, interior to drainboard 22, and is absorbed at least partially by second membrane 44. The applied liquid waterproofing may, for example, be oil-based (e.g. an emulsified oil based sealant), asphalt-based (e.g. asphaltic emulsion), or rubber based, or modified asphalt or rubber based. Waterproofing layer 50 may thus be asphalt, rubber, or combination thereof or the like. Waterproofing may be applied by brush, roller, or spray application, or in any other manner known to those of ordinary skill.

A concrete foundation wall 52 is poured in contact with waterproofing layer 50. The concrete may bond with waterproofing layer 50. Waterproofing layer 50 may thus form a relatively sealed envelope around the resulting foundation. Blindside composite drainboard 22 may be provided in rolls. Rolls may be cut into sheets 40. Rolls of drainboard 22 may be 2 m wide and 12.5 m long. Roll weight is convenient for installers to handle on the jobsite while providing a larger area of coverage (current standard sizes are 4' wide or 6' wide). Other dimensions are, of course, possible. A roll could be 1.5 m wide, 6' wide, 8' wide, etc. and rolls could be shorter or longer, e.g. 5 m long, 10 m long, 20 m long, etc.

Figure 3:
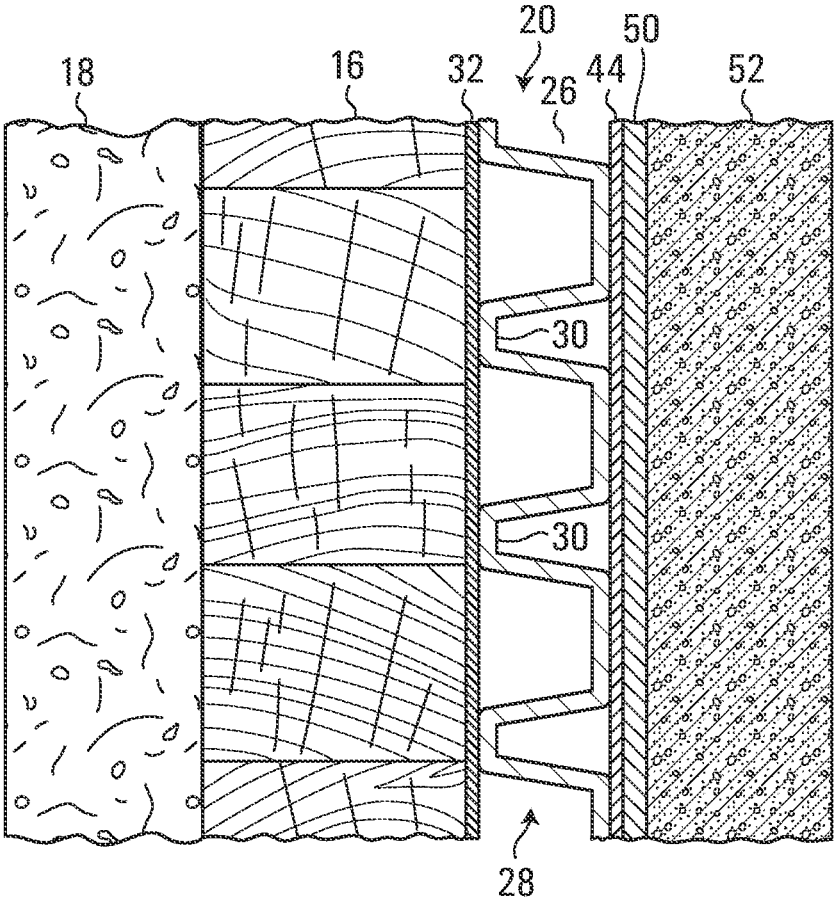
FIG. 3 is an enlarged cross-sectional view a portion of the foundation assembly of FIG. 2.

Composite drainage layer 20, as better viewed in enlarged cross-section in FIG. 3, includes a patterned substrate core 24 having an inward facing surface 26, and opposed outward facing surface 28. Inward facing surface 26 of blindside drainage layer 20 faces away from lagging layer 12. Outward facing surface 28 is in contact with lagging layer 12.

Substrate core 24 is a three-dimensional sheet with projections 30 formed into it to provide a drainage space for water. The thickness of the sheet may be about 0.5 mm, but could be anywhere between 0.2 and 2 mm or more. Substrate core 24 can be made from polymeric material, e.g. polystyrene, polypropylene or polyethylene, or other plastic material that can be extruded and thermoformed, to provide a desired three dimensional profile. Substrate core 24 may take the form of a "dimpled drainage sheet" formed of polypropylene or similar material.

The polymer should be able to be thermoformed into a substrate core 24, to allow projections 30 with a sufficient compressive strength, so they do not collapse under load. A specific high-density polyethylene, suitable for extrusion and thermoforming the particular substrate core 24 that provides compressive strength suitable for blindside drainage applications, may be used. The particular compressive strength of substrate core 24 may be 400 kN/m$^2$; other versions of the substrate core 24 could have lower compressive strength, i.e. as low as 200 kN/m$^2$ or even as low as 100 kN/m$^2$; or could be higher in compressive strength, e.g. up to 600 kN/m$^2$, or up to 1000 kN/m$^2$, etc.

Substrate core 24 includes a plurality of projections 30, extending to outward surface 28 and forming complementary concavities on the inward surface 26. Projections 30 may be arranged in aligned or in offset rows. Spacing between projections 30 provides tortuous paths on outward surface 28, allowing for the downward drainage of water along outward surface 28. In the depicted embodiment, each projection 30 is frustoconical, having a base diameter of about 8 mm a top diameter of about 6 mm and a height of about 10 mm. Other dimensions will be apparent to those of ordinary skill.

Protrusions 30 can take various shapes and configurations: round, square, octagon-shaped, triangular shaped, diamond shaped, bone shaped, or the like. They can vary in diameter and height; they can vary in angle of the wall to the flat part of substrate core 24 (e.g. 90 degree angle, 70 degree angle, 50 degree angle, etc.). Protrusions 30 can be aligned (in production and/or cross direction of the drainboard), or they can be offset (e.g. by 45 degrees). In an embodiment, protrusions 30 are round, 8 mm high, with a wall to base sheet angle of 80-90 degrees, diagonally offset by 45 degrees. The offset helps to increase compressive strength of protrusions 30 by allowing a larger distance between protrusions 30 in production direction there is more material available to be stretched over a dimple, leading to thicker side walls of the protrusions 30, leading to higher compressive strength, compared to dimples that are aligned in production direction.

Channels formed between projections 30 guide sub-surface water downward (and into gravel 38—FIG. 1) and prevent the build-up of hydrostatic pressure against an adjacent structure. The polyethylene provides impact and tear resistance, and is unaffected by environmental stress cracking.

A membrane 32 is attached to outward facing surface 28 of substrate 24. Membrane 32 may be 0.3 mm and 0.5 mm thick, but could be thick as 2 mm or more.

Once composite drainboard 22 is installed, as shown in FIGS. 1, 2, 3 and 4, membrane 32 is adjacent lagging layer 12. Membrane 32 may be made of a geotextile—formed of polymeric material, e.g. polyethylene, polypropylene, polyester; it can be woven (e.g. woven polypropylene monofilaments) or a non-woven fabric. If non-woven, it can be heat bonded, or spunbond, or needlepunched or with a specific nonwoven geotextile. Suitable geotextiles will have tear strength, puncture resistance, and apparent opening size to ensure good performance of composite drainboard 22.

Membrane 32 keeps fine soil particles from being washed between protrusions 30 clogging drainage layer 10, keeps drainage channels (between protrusions 30) clear of sludge, so that water may be drained off and thus further protect a building from moisture. Additionally, under pressure, membrane 32 does not stretch as much as for instance a needlepunched geotextile would stretch, thus not intruding as deep into the drainage space between protrusions 30 when under load.

Membrane 32 may be attached in such a manner to the outward surface 28 that protrusions 30 of substrate 24 is covered Membrane 32 may be attached to surface 28 through thermal bonding (no adhesive). Alternatively, membrane 32 could be attached using adhesive or mechanical fastening. The geotextile may be fully bonded to protrusions 30 to prevent membrane 32 from being pushed into the flow channels by the load from adjacent back-fill material. Example geotextile meets AASHTO M288 Class 3.

An additional, second, fiber membrane 44 is attached to substrate core 24 and covers inward surface 26, thereby covering the voids created on inward surface 26 by protrusions 30, to provide a substantially smooth coating to inward surface 26.

Membrane 44 is suitably attached to substrate core 24 during manufacture. Membrane 44 may, for example, be thermally bonded, or attached via adhesive, or mechanically bonded.

For example, a spray adhesive may be used to apply membrane 44 to inward surface 26 of substrate 24. The entirety of inward surface 26 may be covered with spray adhesive. Adhesive could also be used via a roll-coater to achieve full-surface coating with adhesive. For example, adhesive could also be applied in patterns (e.g. stripes, checker, circles, etc.). Adhesive can be pressure-sensitive hotmelt adhesive, or other hotmelt, butyl based, acrylic-based, or any other type of adhesive Alternatively, membrane 44 could be attached to the substrate core 24 mechanically by way of fasteners (e.g. staples, nails, rivets, or the like) or otherwise, or via thermal bonding (heating up either the inner surface 26 of substrate core 24 or the backside of membrane 44 in a way that the two layers can melt together and create a mechanical bond).

If an adhesive is used, it could be applied to substrate core 24 and membrane 44 may be bonded to substrate core 24; or the adhesive could be applied to substrate core 24, and membrane 44 and substrate are thereafter pushed/bonded together.

Membrane 44 may be formed of a suitable material—and could for example be formed of a material that provides a suitable, smooth surface that can be bonded to the substrate; for example, it could be a plastic sheet (membrane, foil) made of polyethylene or polypropylene or any other polymeric material; it could also be a fabric or geotextile; the fabric/geotextile could be a woven material or non-woven; the fabric could be made of glassfibers, or of polymeric material, or more specifically it could be made of polyethylene or polypropylene or polyester or other polymeric/plastic materials. Fabrics made of polymers could be spunbond or needlepunched.

In the depicted embodiment, a needlepunched polypropylene fabric is used as membrane 44. This needle-punched polypropylene fabric exhibits relatively high absorption for liquid-applied waterproofing. The waterproofing is at least partially absorbed into this fabric. If a spray waterproofing that sets quickly is applied, this allows for thick/heavy spraying in one course without the liquid-applied waterproofing running.

Membrane 44 thus exhibits higher liquid absorption than substrate core 44. In this way applied liquid applied waterproofing may better adhere to drainboard 22. Moreover, membrane 44 provides a relatively flat surface that may be uniformly coated. Liquid waterproofing thus need not cover the voids created by protrusions 30 on inward surface 26.

Absorption may be measured in a number of ways, directly or indirectly. For example—ISO 811:2018 "Determination of resistance to water penetration—Hydrostatic pressure test" may be used as a proxy for absorption, with lower water penetration resistance signifying higher absorption. In the depicted embodiment, membrane 32 may have a water penetration resistance (as measured in accordance with ISO 811) of less than 5 cm. In an alternate embodiment, membraned 32*a* water penetration resistance of less than 1 cm). Substrate core 24, may have a water penetration resistance of more than 100 cm (as measured in accordance with ISO 811). And, membrane 44 may have a water penetration resistance of less than 2 cm (as measured in accordance with ISO 811). In alternate embodiments, membrane 44 may have a water penetration resistance of less than 1 cm, or even less than 0.8 cm.

In this way, membrane 44 absorbs some of the liquid applied waterproofing, allowing for a more even coat.

Furthermore the particular fabric used to form membrane 44 may be heat-treated on one side to smooth any fibers that may otherwise stand out from the surface (albeit small, they could otherwise penetrate through the liquid-applied waterproofing and act as a "wick" to water (slowly seeping through the waterproofing layer).

Additionally, the color of membrane 44 may be chosen to contrast with the color of membrane 32, and any applied waterproofing layer 50 (unlike standard black geotextile typically used in construction) as this will provide good contrast when liquid-applied waterproofing is applied (typical waterproofing is black), allowing the waterproofing installer to clearly see where he has sprayed/not sprayed, thus helping to ensure that a continuous layer of waterproofing is applied everywhere. If small areas have been missed by the applicator, these areas will be easy to identify during a jobsite inspection.)

The fabric used as membrane 44 has a typical weight of around 3.6 oz/sq yard. Weight could range between 0.5 Oz/sq yard and 6 Oz/sq yard, or for example between 3.3 Oz/sq yard to 3.9 Oz/sq yard (production tolerances). Membrane 44 may have a thickness of between 0.5 mm and 2.5 mm, or even up to 4 mm.

This type of fabric allows for good bonding of liquid waterproofing due to the surface structure provided by the needle punched polypropylene fibers; it also improves the tensile strength of the liquid-applied waterproofing, thus acting as a reinforcement for the waterproofing enabling it to span larger unsuspended areas (e.g. voids behind the drainboard 22 caused by details around soil anchors, wood lagging, shotcrete walls, etc.)

Figure 6:
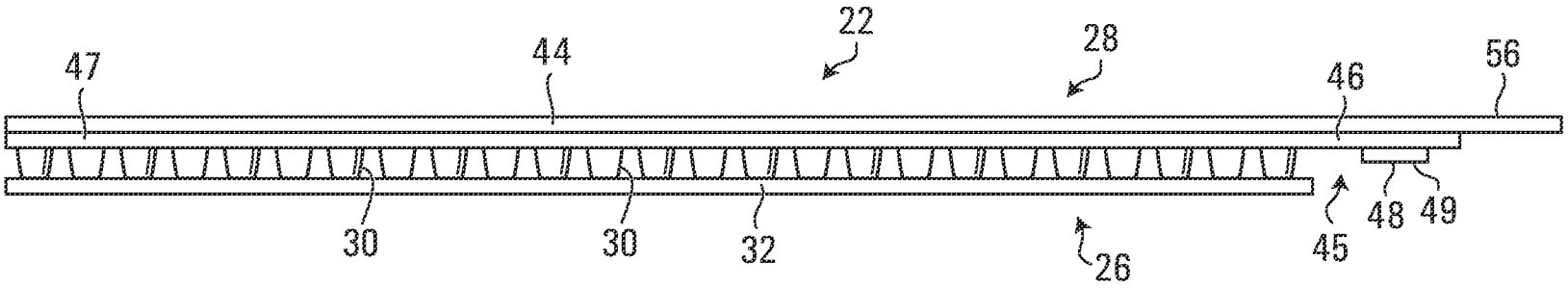
FIG. 6 is a cross-sectional view of a composite drainboard of FIG. 1.

A sheet 40 of drainboard material has a flat region 46 proximate one lateral edge 45. (see FIG. 6). Flat region 46 may be made of the same material as substrate core 24, but lacks protrusions 30. Flat region 46 may alternatively be made of another type of material and adhered or otherwise fixed to substrate core 24. Flat region 46 serves as a tab that aids at the joint to an adjacent sheet 40 of drainboard 22. In this way, a first sheet of drainboard 22 may be installed on lagging layer 12; a next sheet may be butted up so that the drainboard 22 and drainboard layer 20 is continuous, and the flat region 22 of the second sheet overlaps the previously installed first sheet of drainboard 22. This ensures that there is no open gap between sheets 40 of drainboard 22. As such, liquid-applied waterproofing may be applied continuously across sheets.

Flat region 46 may be approximately 7 cm wide extending from edge 45, but could be smaller or larger, e.g. 5 cm, or even smaller; or e.g. 15 cm, or even larger than that.

An adhesive strip 48 is further applied to the flat region 46 that allows flat tab to be sealed to core 24 of an adjacent sheet 40 of drainboard 22. Flat region 46 may be placed in overlapping relationship with opposite edge 47 of an adjacent sheet of drainboard 22. Adhesive strip 48 may be about 2 cm wide, but could also be smaller or larger adhesive strip 48 may be around 1 mm thick, but could also be thinner or thicker. The adhesive used for adhesive strip 48 on flat region 46 may be a pressure-sensitive hotmelt adhesive (butyl based); or another type of pressure sensitive adhesive, or an adhesive that is activated via moisture/humidity or heat or UV, etc. The adhesive could also be acrylic based.

A siliconized release layer 49 is applied to adhesive strip 48, so that the adhesive does not adhere to any surface until drainboard 22 is installed on the jobsite. A person applying the drainboard 22 may manually remove the release film, so that flat tab 46 will adhere to the substrate core 24 (near edge 47) of the adjacent sheet 40.

Membrane 44 fixed to the surface 28 of drainboard 22 is applied to substrate core 24 in such a manner that the opposite edge 47 of substrate core 24 is not covered by membrane 44 (see FIG. 4), so that flat region 46 is truly sealed to substrate core 24, and not membrane 44. In another—less desirable—embodiment, membrane 44 could cover the entire backside of the substrate core (without an exposed area of the core).

Membrane 32 similarly does not cover region 46 (there is no overhang of the membrane 32 at the flat region or beyond). Alternatively, membrane 32 attached to the front side of protrusions 30 may have an overhang at the flat tab of the substrate core 24 or beyond, but this may increase the complexity of the installation of the drainboard 22.

Adhesive strip 48 on flat tab provides extra protection in the seam area (typically the weakest spot in a drainboard/waterproofing application).

Membrane 44, has an overhang 56 on the tab formed by region 46. Overhang 56 of membrane 44 may also be around 7 cm wide (extending to or past the edge of flat region 46). In other versions of the product, overhang 56 could also be smaller (e.g. 4 cm) or bigger (e.g. 10 cm).

Overhang 56 of membrane 44 on the surface 28 provides a suitable and continuous substrate for the liquid-applied waterproofing. Overhang 56 can be easily affixed by an applicator by applying some liquid waterproofing (or other suitable material, e.g. adhesive) in the flat tab overlap area and then pushing the membrane 44 against the liquid. Overhang 56 further provides a reinforcement for liquid-applied waterproofing in the overlap areas that could not be achieved adjacent sheets of drainboard 22, without overlap.

Interior to fiber membrane 44 is a layer of waterproofing 50, applied as liquid waterproofing. As noted, waterproofing 50 may be bitumen or asphalt, and may be emulsified. Other liquid waterproofing 50 may be used. Waterproofing 50 may be applied by spray, brush or otherwise.

Notably, membrane 44 absorbs at least in part the liquid applied waterproofing that may be applied thereto. In order to avoid sagging of membrane layer when a liquid-applied waterproofing is later applied to the substrate, membrane 44 is firmly adhered to inner surface 28. The liquid waterproofing will apply weight to membrane 44, and if membrane 44 is not firmly adhered, it may sag due to the weight of any applied water proofing, causing an irregular surface and making it more difficult to achieve a consistent, monolithic waterproofing layer of uniform thickness.

Finally, a foundation wall 52 is poured of concrete, directly against liquid-applied waterproofing layer 50. Foundation wall 52 thus has an outer face in contact with and typically mechanically bonded to liquid-applied waterproofing layer 50.

No wrinkles in membrane 44 ensure a quicker application of the liquid-applied waterproofing, as it eliminates the need to spray "wrinkled" areas more intensely.

Liquid waterproofing layer 50 applied in consistent thickness ensures material savings as a result of the flat/smooth surface of the membrane 44.

Of course, the above described embodiments are intended to be illustrative only and in no way limiting. The described embodiments are susceptible to many modifications of form, arrangement of parts, details and order of operation. The invention is intended to encompass all such modification within its scope, as defined by the claims.

What is claimed is:

1. Composite drainboard comprising:

a patterned substrate core having an inward surface, and opposed outward facing surface, said substrate core comprising a plurality of projections, forming concavities on said inward surface;

a first geotextile membrane attached to said substrate core and covering said outward facing surface;

a second fiber membrane attached to said substrate core and covering said inward facing surface and said concavities to provide a substantially smooth coating to said inward surface;

wherein said second fiber membrane is configured to allow application of an external liquid-applied waterproofing layer atop said second fiber membrane; wherein the external applied waterproofing layer is at least partially absorbed by the second fiber membrane and is to be positioned between said inward facing surface and in contact with an adjacent poured concrete layer.

2. The composite drainboard of claim 1, wherein said patterned substrate has opposing first and second lateral edges, and wherein said second membrane comprises an overhang that overhangs said second lateral edge of said patterned substrate.

3. The composite drainboard of claim 1, wherein said second membrane at least partially absorbs an emulsified sealant.

4. The composite drainboard of claim 2, further comprising a lengthwise extending adhesive strip formed on said overhang, extending generally parallel said second lateral edge.

5. The composite drainboard of claim 4, wherein said lengthwise extending adhesive strip is covered with a release layer.

6. The composite drainboard of claim 4, wherein said lengthwise extending adhesive strip is pressure sensitive.

7. The composite drainboard of claim 6, wherein said second membrane leaves a strip of said inward facing surface extending from said first edge uncovered.

8. The composite drainboard of claim 6, wherein said second membrane is formed of polymeric material.

9. The composite drainboard of claim 6, wherein said second membrane is formed of polyethylene, polypropylene, or polyester.

10. The composite drainboard of claim 9, wherein said second membrane is non-woven.

11. The drainboard of claim 10, wherein said second membrane is heat bonded, spunbond, or needlepunched.

12. A foundation assembly, comprising:

a lagging layer adjacent to soil;

a blindside drainage layer comprising:

a drainboard with a patterned substrate core having an inward surface, and opposed outward facing surface, said outward facing surface connected to said lagging layer, said substrate core comprising a plurality of projections, forming concavities on said inward surface;

a geotextile membrane attached to said substrate core and covering said outward facing surface;

a fiber membrane attached to said substrate core and covering said inward surface to provide a substantially smooth coating to said inward surface, wherein said fiber membrane absorbs a liquid waterproofing;

a liquid-applied waterproofing layer, applied to said fiber membrane, and at least partially absorbed by said fiber membrane;

a poured concrete layer poured directly against said liquid-applied waterproofing layer having an outer face in contact with said liquid-applied waterproofing layer.

13. The foundation assembly of claim 12, wherein said liquid waterproofing forms a waterproof envelope on an exterior of said concrete layer, between said concrete layer and said drainboard, and adjacent drainboards.

14. The foundation assembly of claim 12, wherein said lagging layer comprises wood.

15. The foundation assembly of claim 13, wherein said a fiber membrane covering said inward surface is glued to said inward facing surface of said substrate core.

16. The foundation assembly of claim 12, wherein said inward surface of said fiber membrane has been heat treated to smooth said inward surface.

17. The foundation assembly of claim 12, wherein said waterproofing layer comprises asphalt, bitumen or rubber.

18. The foundation assembly of claim 12, wherein said fiber membrane overhangs a lateral edge of said drainboard to cover an adjacent drainboard of said blindside drainage layer.

19. A method of forming a foundation, comprising:

forming a lagging layer adjacent to soil;

installing a plurality of composite drainboards on the lagging layer, each of said plurality of composite drainboards comprising:

a patterned substrate core having an inward surface, and opposed outward facing surface, said substrate core comprising a plurality projections, forming concavities on said inward surfaces;

a first geotextile membrane attached to said substrate core and covering said outward facing surface;

a second membrane attached to said substrate core and covering said inward facing surface and said concavities to provide a substantially smooth coating to said inward surface;

applying liquid waterproofing to said second membrane to form a waterproofing layer;

pouring a concrete layer after applying said liquid waterproofing and in contact with said waterproofing layer to form a concrete wall.

20. The method of claim 19, wherein said plurality of composite drainboards are placed adjacent to each other, and wherein said liquid waterproofing seals gaps between said plurality of drainboards.

21. The method of claim 20, wherein each of said plurality composite drainboards comprises two opposed edges, and wherein said second membrane overhangs at least one of said two opposed edges, onto an adjacent one of said plurality of drainboards.

22. The method of claim 21, where said liquid waterproofing forms a waterproof envelope exterior to said concrete layer.

23. The method of claim 22, wherein said liquid waterproofing comprised an asphalt emulsion or a bitumen or rubber base emulsion.

* * * * *